United States Patent [19]

Dietrich

[11] 4,036,137

[45] July 19, 1977

[54] METHOD AND MEANS OF EXTRACTING A SOIL ANCHOR CONSISTING OF A PRESTRESSED STEEL TENDON

[75] Inventor: Hans Dietrich, Bolligen, Switzerland

[73] Assignee: Losinger AG of Bern, Switzerland

[21] Appl. No.: 586,801

[22] Filed: June 13, 1975

[30] Foreign Application Priority Data

June 19, 1974 Switzerland ..... 8424/74

[51] Int. Cl.[2] ..... F42D 1/00

[52] U.S. Cl. ..... 102/23; 52/166

[58] Field of Search ..... 102/23, 22, 21, 20; 299/13; 52/742, 166

[56] References Cited

U.S. PATENT DOCUMENTS

| | | | |
|---|---|---|---|
| 1,746,848 | 2/1930 | Bates | 52/166 |
| 2,048,677 | 7/1936 | Berteling | 102/23 |
| 3,115,226 | 12/1963 | Thompson | 52/166 |
| 3,494,134 | 2/1970 | Jorge | 52/166 X |
| 3,618,520 | 11/1971 | Hamasaki et al. | 102/23 |

FOREIGN PATENT DOCUMENTS

| | | | |
|---|---|---|---|
| 1,534,925 | 6/1968 | France | 102/23 |

*Primary Examiner*—David H. Brown

[57] ABSTRACT

Method and means of extracting a soil anchor consisting of a prestressed steel tendon anchored in a soil comprising introducing an explosive in a tube placed in the center of said steel tendon, detonating and blasting said explosive, by which explosion the hardened anchorage surrounding the lower part of said anchor is loosened, and pulling the whole length of the loosened anchor out of the soil.

2 Claims, 2 Drawing Figures

METHOD AND MEANS OF EXTRACTING A SOIL ANCHOR CONSISTING OF A PRESTRESSED STEEL TENDON

FIELD OF THE INVENTION

The invention relates to a method of extracting a soil anchor consisting of a prestressed steel tendon anchored in a soil and serving as underpinning means for a building ground such as a retaining wall, an embankment, an excavation wall, etc.

BACKGROUND OF THE INVENTION

The anchor comprising a confinement member reaching to the bottom of a borehole predrilled in the soil in which the anchor is introduced and bonded with the surrounding soil by means of a hardening agent injected in said borehole, and fixed by the hardened agent in the soil, and a stressed tension member accommodated in an encasing tube reaching up to an anchoring plate covering said borehole from outside, a tube being placed in the center of said steel tendon along the entire length of the anchor, said tube being introduced simultaneously with said anchor into the borehole and means to perform the method.

The method of underpinning building grounds, support walls, embankments or similar by using prestressed rock or soil anchors is a widely used system used when constructing buildings below and above ground levels, by constructing roads and railways etc. Considerable supporting forces are needed in sliding areas to secure the soil masses threatening to drop; this can be achieved by means of prestressed rock or soil anchors by means of which the loads can be directly absorbed.

To apply the soil anchors, holes will be driven first in the soil in which the anchors consisting of steel strands, wires or steel bars will be inserted. The fixing of an anchor in the ground site is carried out in such a way that the ends of the longitudinal elements of the anchor, which reach to the bottom of the borehole, will be connected with the surrounding soil by means of an injected cement grout. The remaining tension portion of the anchor is protected by a plastic sheath and is accordingly stressed as desired after the cement grout has been hardened.

In some cases, as when preparing a ground site, the anchors will be extracted from the soil after the building has been completed. In such cases it was usual to cut the anchor between its confinement and tension members. In this way it is possible to pull out the tension member of the anchor out of the soil. However, the confinement member with the injection body cannot be readily pulled out of the ground along with the tension member out of the soil which is generally unsatisfactory. The grouted portion of the anchor which remained in the soil had to be excavated afterwards by means of a shovel dredger, a traxcavator or a loader. However, such an excavating work is very complicated because the cement mortar block surrounding the longitudinal elements consisting of strands, wires or bars can have a length of about 5 meters and a width of about 1 meter.

Another known prior art of extracting soil anchors out of the soil consists in using a boring machine with a round hollow drill having its inside diameter considerably larger than the outside diameter of the anchor. It will be drilled with the boring machine into the depth upto and including the hard cement mortar block whereafter the anchor can be pulled out of the soil as a whole. Even this method is disadvantageous because of the high costs, excessive noise, and comparatively large space required.

SUMMARY AND OBJECTS OF THE INVENTION

It is an object of the invention to substantially eliminate the above-mentioned shortcomings and provide a method of extracting a soil anchor consisting of a prestressed steel tendon in which the anchor will be completely pulled out of the soil, whereby the costs connected with this method are kept low and the method of operation is in no way tiresome and time-consuming.

This object of invention is achieved with the above-mentioned method which is characterized in that a tube which serves as explosion tube into which an explosive is inserted along the entire length of the confinement member of the anchor, whereafter it is detonated, by which explosion a hardened agent surrounding the confinement member is blasted, the bond steel/hardening agent is loosened and the whole length of the loosened anchor is pulled out of the soil by means of a pulling apparatus.

The method is characterized by an exploding tube of plastic which is coaxial with the anchor and comprises a charge tube having a fuse cord and an electric detonator attached thereto, said charge tube being introducable into said explosion tube.

The invention will be made more comprehensible by a drawing in which:

DESCRIPTION OF A PREFERRED EMBODIMENT

Figure 1:
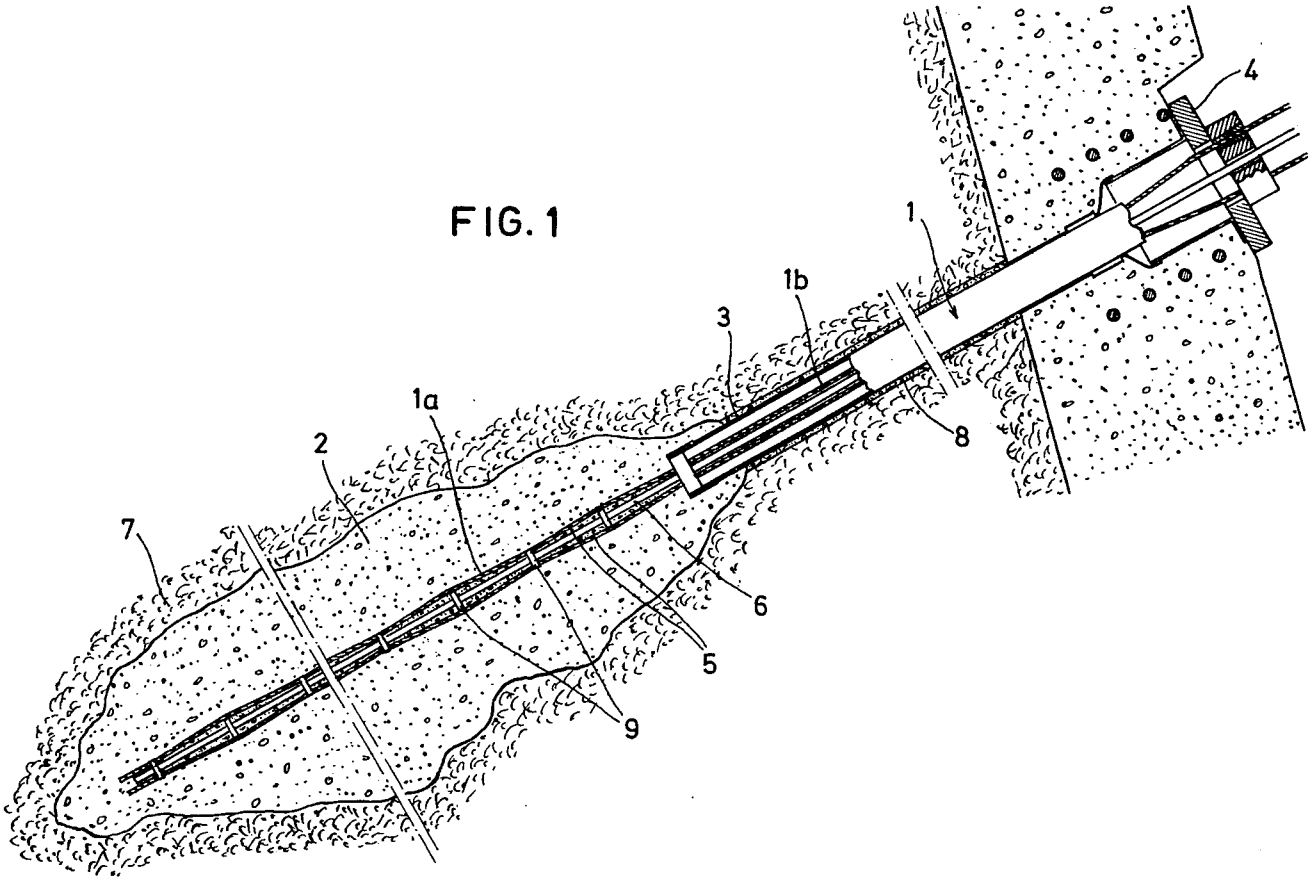
FIG. 1 shows an elevation of a prestressed soil anchor, partially in section.
Figure 2:
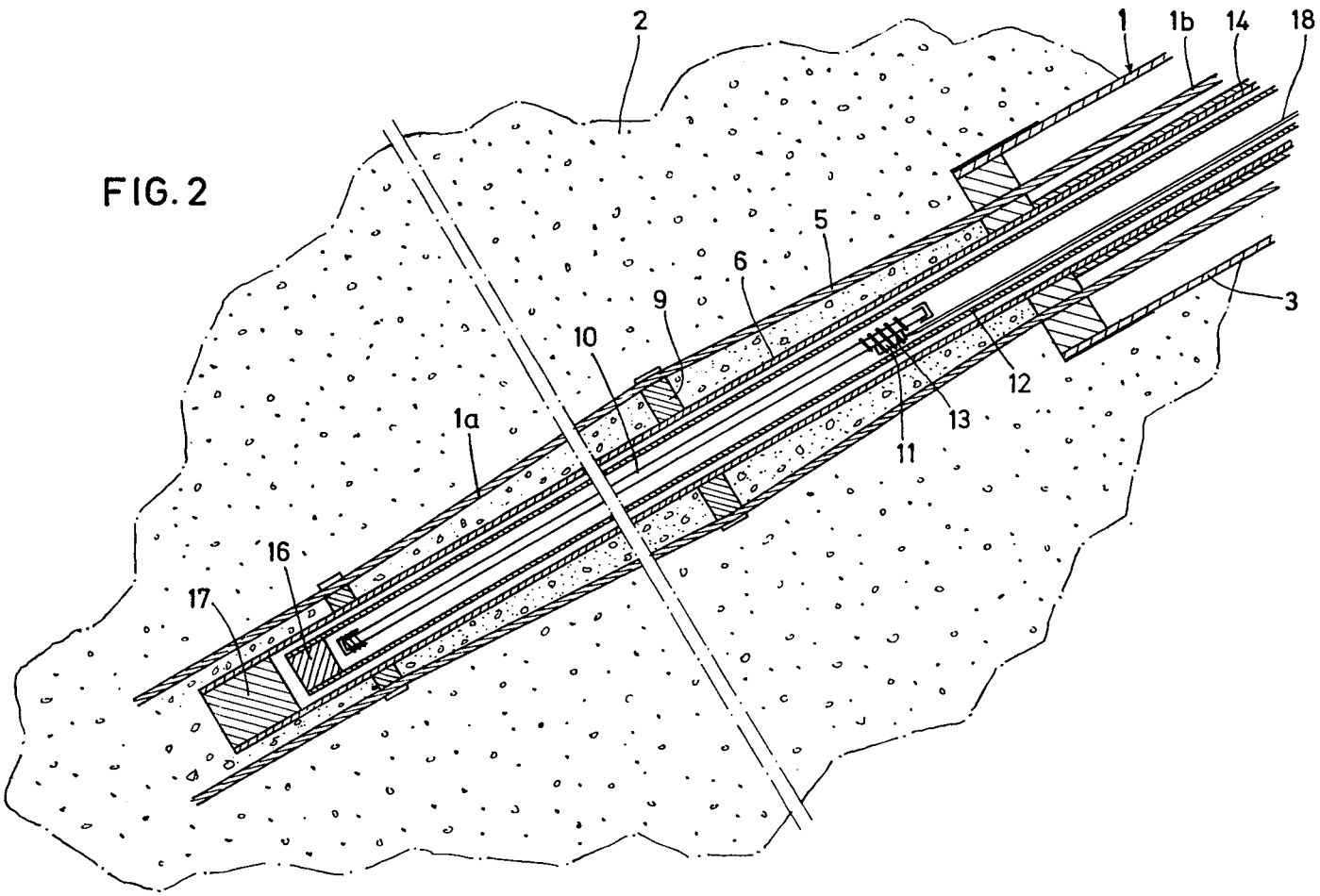
FIG. 2 shows a sectional elevation of the grouted portion of the anchor according to FIG. 1 on a bigger scale.

An anchor 1 consisting of steel strands 5 is inserted in a borehole 8 which has been predrilled in the soil 7. The confinement portion 1*a* of the anchor 1 consisting of free strands 5 reaches to the bottom of the borehole 8 and is surrounded by an injected cement grout 2. The confinement portion 1*a* of the anchor 1 will be connected with the surrounding soil 7 by the injected cement grout 2 and after the cement grout 2 has hardened, the confinement portion 1*a* is fixed in the soil 7. The tension portion 1*b* of the anchor 1 is surrounded by a plastic tube 3 protecting the strands 5 from the soil 7 by which they are surrounded and from coming in touch with the injected material.

During the drilling operation, the borehole 8 has to be protected in a known manner against collapse of the surrounding material by a shield tube. After the borehole 8 has been drilled to the desired depth, the drilling apparatus will be removed from the same and a complete, prefabricated anchor is introduced in the shield tube which remained in the borehole. Then grout 2 is injected under pressure into the space between the inner wall of the shield tube and the outer wall of the plastic tube 3, the shield tube is simultaneously retracted from the borehole 8. In this manner, also, the space between the borehole wall and the outer wall of the plastic tube 3 is filled with the grout 2. The anchor plate 4 is installed after the completion of the injection process.

After the cement grout 2 around the confinement portion 1*a* has hardened, which takes approximately three days, the anchor 1 will be stressed across an anchor plate 4 which covers the entry of the borehole 8. The tension portion 1*b* of the anchor 1 reaches up to the anchor plate 4. Previously during the manufacture of the anchors there will have been placed in the center of the strands bundle 5, over its entire length, a polyethylene tube 6, the so called "explosion tube", which will be inserted along with the anchor 1 in the borehole 8. The outside diameter of the explosion tube 6 is such that it can be well placed in the center of the strands 5; it measures approximately 25 up to 29 mm. The explosion tube 6 has to be reinforced over the tension member 1*b* of the anchor 1 by a steel casing 14 so that it can take up the transverse forces of a strands 5 which are caused e.g. by the crooked borehole 8. The explosion tube 6 reaches, with its end closed by a wood plug 17 to the bottom of the borehole 8 where it is arranged in the center of the free strands 5 which usually form six upto eight waves of 60 cm which are connected by means of steel bands 9.

After the work has been completed and the prestressed anchor has to be pulled out of the ground, a charge tube 12 of plastic having a diameter of 16 to 20 mm is introduced in the explosion tube 6 over its entire length. The charge tube 12 contains a fuse cord 10, the length of which corresponds approximately with the length of the confinement member 1*a* of the anchor 1, and a detonator 11 which is attached to the fuse cord 10 by means of an insulation tape 13. The end of the charge tube 12, to be introduced in the explosion tube 6, is closed by a wood plug 16. The introduction of the charge tube 12 with an explosive in the explosion tube 6 is therefore very simple and safe. A damping (taming or compacting) of the explosive is not necessary.

The electric detonator 11 is highly insensitive in order to afford protection against an accidental explosion which might be caused by the electric waves prevailing in cables already laid in the ground. It may be stiffened by a wire produced, for example, from copper, alunimium or brass. The detonator 11 is connected with a not shown, ignition device by means of two detonator wires 18; the ignition device is to be attended by a demolition expert.

When the fuse cord 10, placed in the confinement member of the anchor 1, is caused to explode, a plurality of cracks originate in the hardened cement block 2 surrounding the free strands 5 so that the bond between the strands 5 and the block will be loosened and the strands broken. The pulling force of the prestressed tension portion 1*b* of the anchor 1 contributes equally to the loosening and displacing of the free strands of the confinement portion 1*a.* The anchor 1 loosened by the explosion is then pulled out by a pulling device (not shown), e.g. a suitable winch, having the necessary power to pull the entire length of the anchor will be pulled out of the soil 7.

By blasting the fuse cord 10, the compact cement mortar block having a length of to 5 *m* and a width of to 1 *m* will be ruptured into smaller pieces which remain burried in the soil 7. By breaking up the big block of the cement mortar into small pieces from inside i.e. below the ground surface, the environment will not be polluted, because the pieces can remain buried in the soil as its component parts such as grit, lime etc. mix easily with the soil. The blasting is carried out while prestressing by which the loosening effect is enhanced. By using the above-mentioned method, neither noise or shocks occur nor does gas develop.

What we claim is:

1. A method of extracting a ground anchor embedded in the ground and including a prestressed tendon having a confinement member and a stressed member, said confinement member extending to the bottom of a borehole in the ground in which the anchor was introduced and bonded therein by a hardening agent injected into the borehole and surrounding and bonded to the confinement member, said stressed tension member extending through an encasing tube to an anchor plate at the entry of the borehole, whereby a hollow loading tube was placed substantially centrally and longitudinally of substantially the entire length of said tendon and introduced simultaneously with the anchor into said borehole, the improvement comprising:

A. introducing an explosive into the last-mentioned tube along the entire length of the confinement member;

B. detonating the explosive and rupturing the hardened agent surrounding the confinement tube and loosening the bond with the confinement member; and C. withdrawing the loosened tendon out of the soil in which the anchor was embedded.

2. The method as claimed in claim 1 including the step of:

loosening and displacing the confinement member of said embedded anchor, during detonation of the explosive, in part from the release of the stressed tension member.

* * * * *